US005696741A

United States Patent [19]

Nussbaum

[11] Patent Number: 5,696,741

[45] Date of Patent: Dec. 9, 1997

[54] TIMEPIECE INCLUDING A FLUID RESISTANT CONTAINER ASSEMBLED IN A METALLIC CASE

[75] Inventor: André Nussbaum, Bienne, Switzerland

[73] Assignee: Eta SA Fabriques d'Ebauches, Grenchen, Switzerland

[21] Appl. No.: 552,053

[22] Filed: Nov. 2, 1995

[30] Foreign Application Priority Data

Nov. 4, 1994 [CH] Switzerland ..... 03 295/94

[51] Int. Cl.[6] ..... G04B 37/00

[52] U.S. Cl. ..... 368/281; 368/276; 368/289; 368/291

[58] Field of Search ..... 368/289, 291, 368/292, 276, 281, 282

[56] References Cited

U.S. PATENT DOCUMENTS

| | | | |
|---|---|---|---|
| 2,230,330 | 2/1941 | Marti | 368/289 |
| 2,382,728 | 8/1945 | Kupchick | 368/291 |
| 2,547,090 | 4/1951 | O'Neill | 368/291 |
| 2,862,352 | 12/1958 | Burghoff | 368/289 |
| 3,577,876 | 5/1971 | Spadini | 368/291 |

FOREIGN PATENT DOCUMENTS

| | | |
|---|---|---|
| 2579781 | 10/1986 | France . |
| 377735 | 6/1964 | Switzerland . |

*Primary Examiner*—Bernard Roskoski

*Attorney, Agent, or Firm*—Sughrue, Mion, Zinn, Macpeak & Seas, PLLC

[57] ABSTRACT

The invention concerns a timepiece, specifically a wrist watch, including a fluid resistant container (19) provided with a framework (20) of plastic material housing the horometric components. Such fluid resistant container (19) is closed by a crystal (22) and by a cell holder compartment lid (40) keyed to the framework and it is fitted out with a stem (26) on such framework rendered fluid resistant. The container is assembled and maintained in place in a metallic case (2) by snap securing means, in particular a bezel (18) which axially compresses a flange (20*a*) of the framework (20) and a toroidal seal (42) against the case (2). The case can thus be manufactured with loose tolerances. The assembled fluid resistant container and horological movement can be tested prior to its assembly in the case (2).

10 Claims, 3 Drawing Sheets

TIMEPIECE INCLUDING A FLUID RESISTANT CONTAINER ASSEMBLED IN A METALLIC CASE

The present invention concerns a timepiece, in particular an electronic wristwatch, including a fluid resistant container provided with a framework of plastic material housing horometric components, said framework being assembled and held in place in a metallic case by securing means, said fluid resistant container being closed by a crystal and fitted out with a control stem rendered fluid resistant on the framework.

BACKGROUND OF THE INVENTION

There have already been proposed wristwatches, the movement, the dial and the hands of which are sealed in a fluid resistant container which is thereafter placed in a metallic watch case which is not fluid resistant having the outer aspect of a watch of standard construction. The case then is provided in two pieces which fit into one another approximately at the level of the control stem, each of the two pieces having a semi-circular notch for the passage of a fixed tubular element which surrounds the stem.

For example, the patent CH-377 735 describes a fluid resistant container made up from at least three pieces, namely a crystal of glass, an intermediate piece of plastic material forming a dial and interior caseband and receiving the edge of the crystal and a back cover of plastic material which is snap-fastened onto the interior caseband. In order to receive the control stem which is put into place after the metallic case, there is provided a separate tube driven into the interior caseband or a portion moulded integrally with said caseband.

There results therefrom that the container is not fluid resistant during its assembly into the metallic case since the stem and its sealing arrangement are not yet in place. Additionally, the proposed construction is not suitable for electronic watches in which it is necessary to be able to change the energy cell. For the rest, the securing of the container between the two pieces of the metallic case, more precisely by clamping between the back cover and a portion forming a bezel, necessitates very close tolerances in manufacture, which lead to a relatively high cost of the case. Additionally, the assembly seal at mid-height of the case is unattractive in appearance.

Finally, since the metallic case is not fluid resistant, dirt and Germs can lodge between the case and the container and lead over a period of time to injuries or unpleasantness for the wearer, for example by skin irritations.

Another example of the prior art according to U.S. Pat. No. 2,862,352 includes a known mechanical movement housed in a fluid resistant container which, with the exception of the crystal, is formed from a relatively pliable envelope of synthetic material, the latter covering over a traditional movement framework comprising two base plates and a dial. This construction exhibits the same drawbacks as the preceding example.

SUMMARY OF THE INVENTION

In order to avoid such drawbacks, the present invention has as an object a timepiece, in particular an electronic wristwatch, provided with a metallic case which exhibits the general appearance of a traditional watch case and the cost of manufacturing and assembly of which are very low.

A specific purpose is to obtain a simple and sure assembly of the container in the case without the latter having to undergo precise and expensive machining operations, in particular, if it is manufactured by moulding techniques.

Another specific purpose consists in obtaining a metallic case which is sufficiently fluid resistant to prevent the entry of dirt or germs between the case and the container.

Yet another specific purpose consists in fabricating an electronic watch in a manner to permit testing the movement with the electrical energy cell in its fluid resistant container before assembly into the case, whilst permitting easy replacement of the energy cell after use.

In its most general aspect, the invention concerns a time-piece of the nature indicated hereinabove, characterized in that the securing means include an annular element snap-mounted on the case, a flange projecting from said framework and an annular compressible seal arranged between the projecting flange and the case in a manner such that said flange and said seal are axially compressed between the annular element and the case.

Thus, the movement container can be simply suspended by its projecting flange on the interior of the case in which it requires no support surface other than that on which the annular compressible seal bears. Thanks to the seal, this surface evidently does not require a very high machining precision. An important advantage results in which the back cover of the case does not need to bear on the container and can thus have any form whatsoever and wide manufacturing tolerances, in the same manner as the caseband forming portion below the zone of the securing means.

Preferably, said annular element is in direct axial bearing on the framework. It can advantageously be a bezel which overlies an edge zone of the crystal without touching it.

The framework preferably includes a compartment containing an electrical energy cell and which is closed in a fluid resistant manner by a lid mounted on the framework. The case can then include a back cover having an aperture facing said lid permitting the passage of said lid and of the energy cell in order to change the latter. Preferably, an annular compressible seal is arranged around said aperture between the framework and the case.

In a preferred embodiment permitting use of the control stem during tests prior to assembly of the container within the case, by already providing fluid resistance between the stem and the container, the case is in one piece forming a caseband and a back cover and includes a lateral opening in the caseband into which the control stem is fitted with transversal clearance and cooperates with a fluid resistant seal assembled in said opening.

The invention will be better understood upon reading the description which follows, illustrated by drawings giving an example of one embodiment of the invention.

DESCRIPTION OF THE PREFERRED EMBODIMENT

Figure 1:
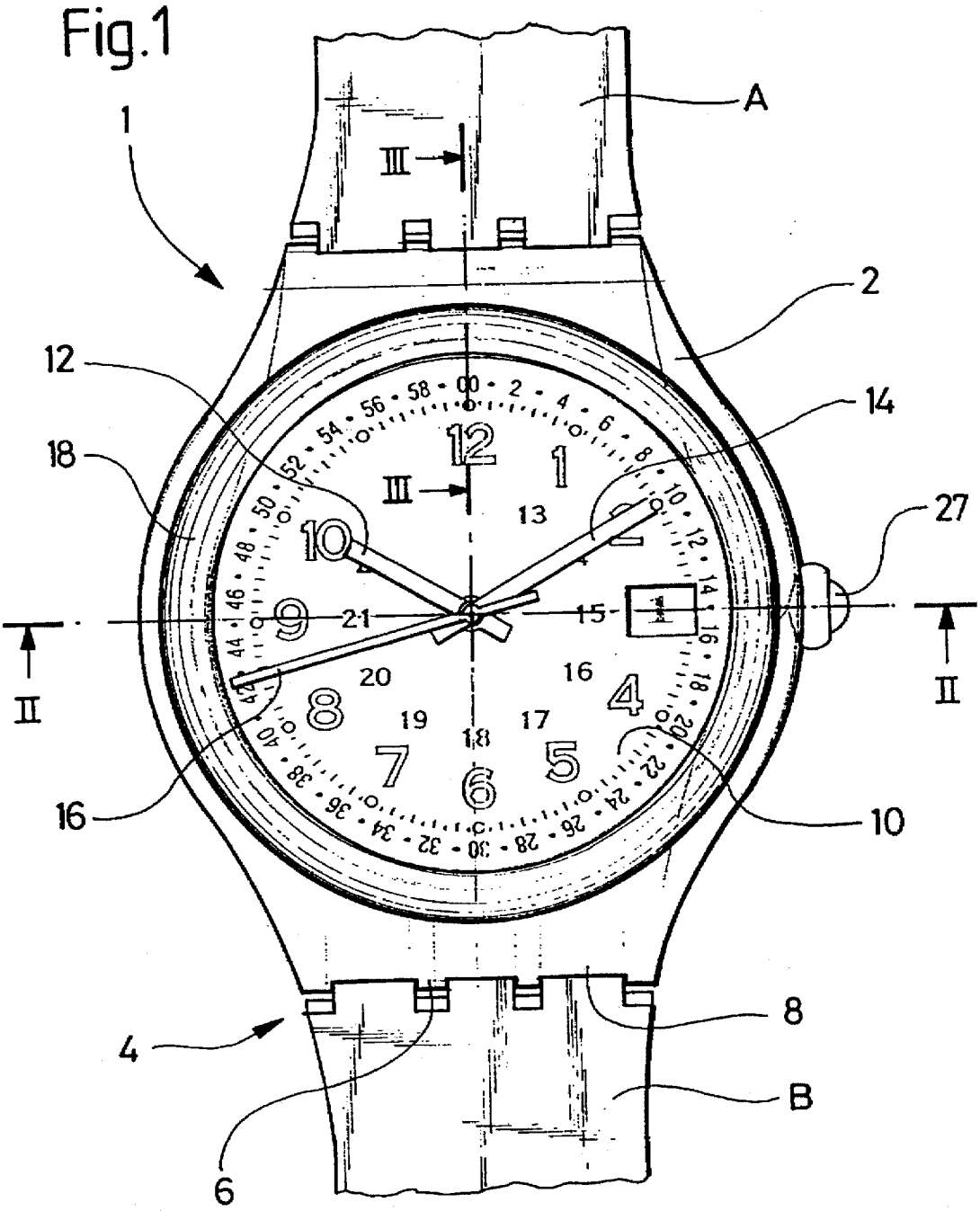
FIG. 1 is a plan view from above of the watch according to the invention.
Figure 2:
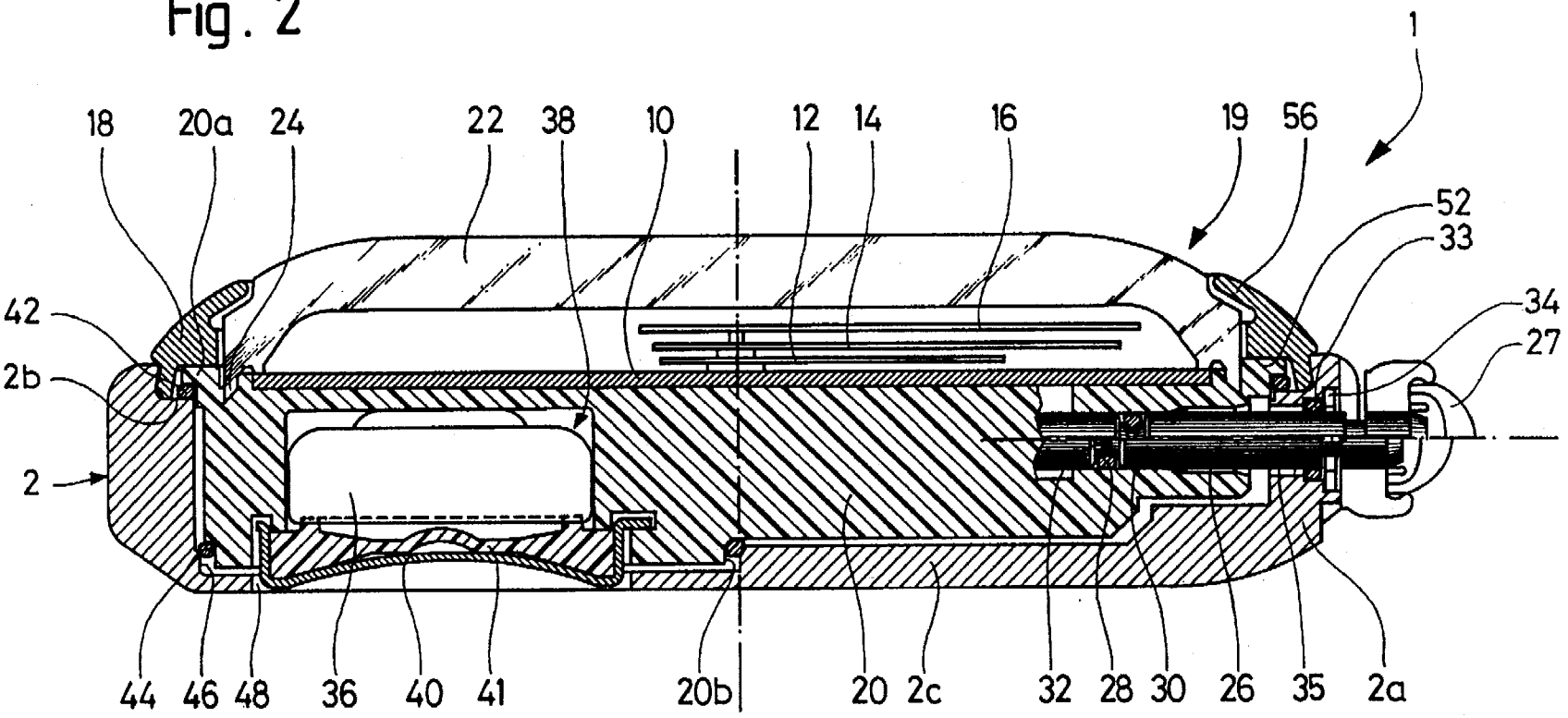
FIG. 2 is a cross-section view taken along line II—II of FIG. 1.
Figure 3:
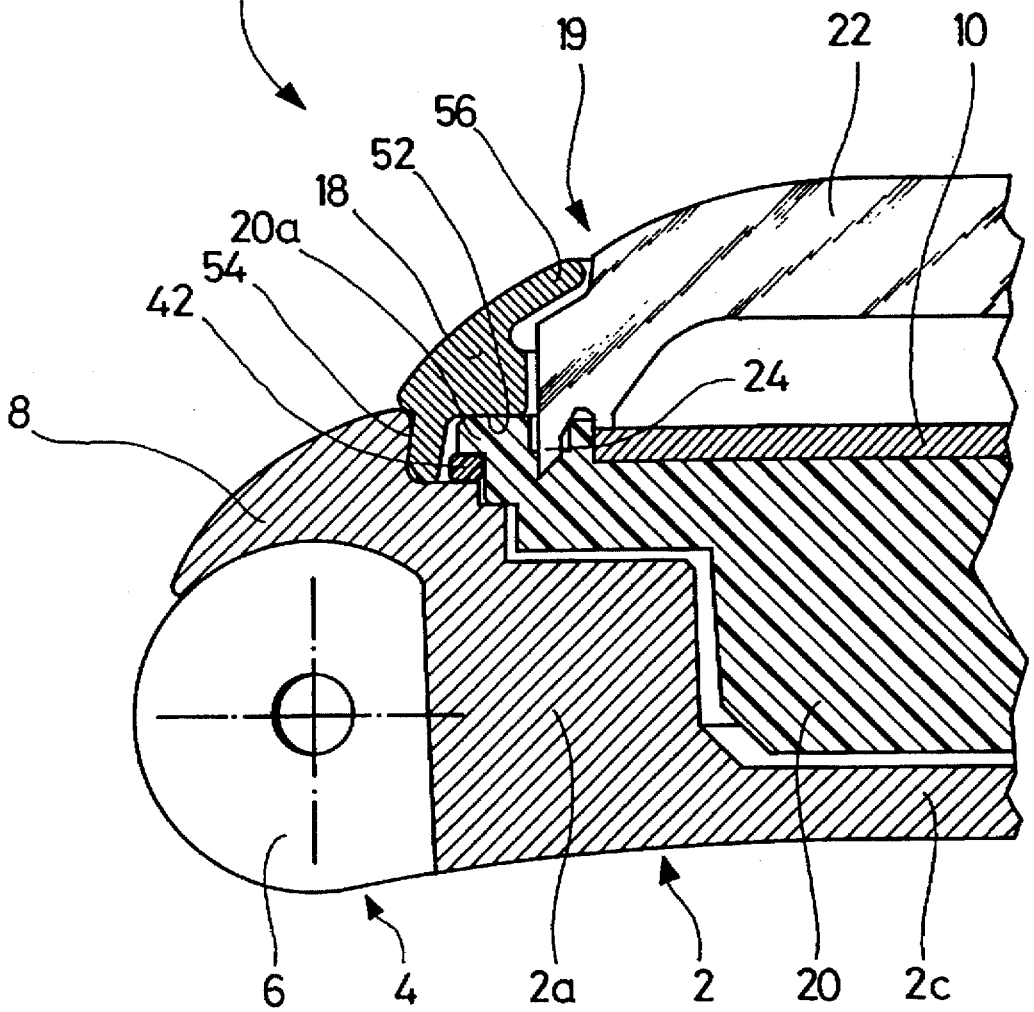
FIG. 3 is a cross-section view taken along line III—III of FIG. 1.

The timepiece 1 shown in the drawings is formed in the embodiment described here by a wristwatch 1 including a case 2 formed of metallic material. The case 2 which is seen in detailed manner on FIGS. 2 and 3 is in one single piece comprising an annular lateral portion 2*a* in the form of a known caseband and a back cover 2*c*. The caseband 2*a* includes, in known manner, bracelet attachment means bearing the general reference 4.

Such attachment means 4 are constituted on both sides of said case by four pierced horns 6 of the type described in U.S. Pat. No. 4,624,581. Such horns 6 which are connected two at a time by covers 8 are integral with case 2 and are also formed of metal. Such horns are shaped in order to be able to receive the two strands A and B of a bracelet through a coupling axis.

Watch 1 further includes a dial 10 above which can be displaced indicating means constituted by an hours hand 12, a minutes hand 14 and a seconds hand 16.

A bezel 18 which can also be formed of a metallic material or be in metallized synthetic material is attached to case 2 by a snap mounting as will be described in a detailed manner hereinafter.

In an advantageous manner, watch 1 according to the invention includes a container 19 comprising a framework 20 formed of plastic material, for example ABS, in which are assembled the electronic and mechanical horometric components enabling the furnishing of time information transmitted to hands 12, 14 and 16. The assembly of such horometric components is described in a detailed manner in the patent CH 643 704. Thus, it is understood that they are directly assembled in the interior of relatively rigid framework 20 forming the plastic container 19.

Container 19 is closed in a fluid resistant manner by a crystal 22, also of plastic material, for example PMMA, the peripheral edge 24 of which is secured in a fixed and fluid resistant manner to the edge of framework 20, for example by ultrasonic welding. Such welding technique of a crystal of plastic onto a support piece also of plastic material is described in U.S. Pat. Nos. 4,648,722 and 4,558,957.

Watch 1 further includes a stem 26 which permits controlling the above-mentioned horometric components. Stem 26 slides on the interior of framework 20, a first toroidal seal 28 being interposed between a cylindrical interior wall 30 of framework 20 and an annular groove 32 of said stem 26.

It will be noted furthermore that a second fluid resistant toroidal seal 33 is interposed between stem 26 and an opening 35 arranged in a lateral portion 2*a* of case 2, such second seal 33 being held in place by a ring 34 fitted in said case. The opening 35 leaves sufficient play around stem 26 to permit slantwise introduction of the latter. A separately added crown 27 is fitted on the free end of stem 26, such crown 27 being put into place on said stem 26 after assembly of container 19 in case 2.

The above-mentioned horometric components of watch 1 are energized by a cell 36 integrally housed in container 19. To this end, in framework 20 a housing is formed referred to as cell compartment 38, which is closed in a fluid resistant manner by a lid 40 of the bayonet type, provided with a seal 41 which bears elastically against framework 20 and cell 36. This type of cell compartment closing on a plastic case is described in the U.S. Pat. No. 4,488,345.

Nevertheless, it is necessary to note here that the lid 40 is not fixed to the back cover 2*c* of the watch case, as is usually done, but to the interior framework 20. It is nevertheless accessible from the exterior as will be described further on.

It will thus be understood, from what has just been described, that the framework 20 in association with crystal 22, lid 40 and stem 26 constitutes an autonomous container 19 which is absolutely fluid resistant and provided with its power cell 36 on which tests for fluid resistance can be effected prior to the assembly of the container 19 in the metallic case 2.

Thus, such fluid resistance tests and all the other quality tests can be brought about before assembly of container 19 in the metal watch case 2, so that assembly of defective horometric components and containers in such case is avoided. There is thus a high assurance that each component and, in particular, every container assembled in a metallic case, is faultless. Thus, operations of disassembly and reassembly of defective containers or movements in the metal cases are eliminated which very substantially diminishes the costs.

As is seen on FIG. 2, container 19 is axially suspended in case 2 through a toroidal fluid resistance seal 42 of compressible material which is interposed between an upper projecting lateral flange 20*a* of framework 20 and an upper corresponding edge 2*b* of case 2. The seal 42 is compressed axially onto the framework 20 by the pressure of the bezel 18. The edge 2*b* of case 2 is here horizontal, but it could have another form, for example, tapered. Thanks to the compressibility of seal 42, the container 19 is elastically held in case 2 and has no need to bear on the back cover 2*c* of the case. The transversal blocking is assured by interior shoulders, not shown, of case 2 below the edge 2*b*.

Another fluid resistant toroidal seal 44 is interposed between a cylindrical bearing surface 20*b* which is arranged at the base of framework 20 around the cell compartment 38 and a corresponding depression 46 formed in the back cover 2*c* of case 2, such back cover being integrally formed with the other portions of case 2.

It will also be noted that the lid 40 of the power cell 36 is accessible from the exterior of case 2 thanks to an open aperture 48 formed in the back cover 2*c* directly in line with the cell compartment 38 The lid 40 projects slightly from case 2 and arrives flush with the outer wall of the back cover 2*c* of case 2.

Thanks to the fastening of container 19 in case 2 solely in the zone of flange 20*a*, there can be advantageously arranged any clearance whatsoever between the case 2 and the container 20, all around the latter, including opposite back cover 2*c*, which permits increasing the dimensional tolerances and reducing the manufacturing costs, for example by using moulding or stamping techniques. The container remains fixed without play, even after ageing of its synthetic material which is preferably of ABS. Such clearance being exteriorly closed by the toroidal seals 33, 42 and 44, humidity and dirt cannot enter therein, which avoids internal damage and the risk of developing of germs susceptible of upsetting the wearer of the watch. Such sealing subsists when the cell compartment 18 is opened.

The fluid resistant container 19 is maintained in place on the interior of case 2 thanks to the metallic or metallized bezel 18, an annular interior bearing surface 52 of which bears axially on the top of the lateral flange 20*a* in order to compress seal 42.

Bezel 18 is snap-held on the case by tapered bearing portions 54 (FIG. 3) arranged respectively on the bezel 18 and in the lateral portion 2*a* of case 2. Bezel 56 overlies the crystal 22 with a cover 18*a* in order to conceal the plastic framework 20. Such cover generally does not touch the crystal, but it can serve as protection against an accidental tearing away of the crystal.

As is well understood, the invention is not limited to the embodiment described hereinabove, which can form the object of numerous modifications and variants. For example, in order to secure container 19 in case 2, there could be employed in place of bezel 18 another annular organ attaching to the case, such organ being adapted to be overlaid by a fixed or rotatable bezel. A compressible element could be interposed between the annular securing element and the upper face of the flange 20*a*. For the rest, the invention is not limited to wristwatches, but could be applied to other timepieces, such as a pendent watch or any other watch provided with a metallic case.

What I claim is:

1. A timepiece including an autonomous fluid resistant container provided with a framework of plastic material and housing horometric components, said fluid resistant container being mounted in a metallic case and maintained in place in said metallic case by securing means, said fluid resistant container being closed by a crystal and fitted out with a control stem rendered fluid resistant on the framework, the securing means including an annular element snap mounted on the case, a projecting flange on said framework and a compressible annular seal arranged between the projecting flange and the case in a manner such that said flange and said seal are axially compressed between the annular element and the case.

2. A timepiece as set forth in claim 1, in which said annular element bears axially directly on the framework.

3. A timepiece as set forth in claim 1, in which said annular element is a bezel which overlies an edge zone of the crystal without touching it.

4. A timepiece as set forth in claim 1, in which the framework includes a compartment containing an electrical energy cell and which is closed in a fluid resistant manner by a lid assembled on the framework.

5. A timepiece as set forth in claim 4, in which the case includes a back cover having an aperture opposite said lid thereby permitting passage of said lid and of the energy cell in order to change the latter.

6. A timepiece as set forth in claim 5, in which an annular compressible seal is arranged around said aperture between the framework and the case.

7. A timepiece as set forth in claim 1, in which the case is in one piece forming a caseband and a back cover and includes a lateral opening in the caseband in which the control stem is installed with a transversal clearance and cooperates with a fluid resistant seal assembled within said opening.

8. A timepiece as set forth in claim 4, in which the case is in one piece forming a caseband and a back cover and includes a lateral opening in the caseband in which the control stem is installed with a transversal clearance and cooperates with a fluid resistant seal assembled within said opening.

9. A timepiece as set forth in claim 1, wherein said case is in one piece forming a caseband and a back cover, said caseband including means for attaching a bracelet to the caseband.

10. A timepiece as set forth in claim 9, wherein said annular element is a bezel which overlies an edge zone of the crystal without touching the crystal.

* * * * *